US009982877B2

(12) United States Patent
Michielan et al.

(10) Patent No.: US 9,982,877 B2
(45) Date of Patent: May 29, 2018

(54) LIGHTING DEVICE AND CORRESPONDING METHOD UTILIZING AN ELONGATED PROFILED BODY WITH WEB WALL HAVING LONGITUDINAL SLOTS AND CONTACT SLIDER MEMBER WITH CORRESPONDING ELECTRICAL PINS

(71) Applicant: OSRAM GmbH, Munich (DE)

(72) Inventors: Valerio Michielan, Scorze (IT); Simon Bobbo, Mirano (IT); Alberto Zanotto, Padua (IT)

(73) Assignee: OSRAM GmbH, Munich (DE)

( * ) Notice: Subject to any disclaimer, the term of this patent is extended or adjusted under 35 U.S.C. 154(b) by 136 days.

(21) Appl. No.: 15/205,054

(22) Filed: Jul. 8, 2016

(65) Prior Publication Data

US 2017/0009973 A1 Jan. 12, 2017

(30) Foreign Application Priority Data

Jul. 8, 2015 (IT) ..... 102015000031983

(51) Int. Cl.
*F21V 23/06* (2006.01)
*F21S 4/28* (2016.01)
(Continued)

(52) U.S. Cl.
CPC ..... *F21V 23/06* (2013.01); *F21S 4/28* (2016.01); *H01R 4/2412* (2013.01);
(Continued)

(58) Field of Classification Search
CPC ..... F21V 23/06; H01R 4/2404; H01R 25/14; F21S 4/28; F21Y 2103/00; F21Y 2103/10;
(Continued)

(56) References Cited

U.S. PATENT DOCUMENTS 3,963,294 A * 6/1976 Heritage ..... F21V 21/02 439/121
4,655,520 A 4/1987 Cummings
(Continued)

FOREIGN PATENT DOCUMENTS

DE 202011051094 U1 11/2012
DE 102013203916 A1 9/2014
(Continued)

OTHER PUBLICATIONS

Italian Search Report based on Application No. 102015000031983(9 Pages) dated Feb. 8, 2016.

*Primary Examiner* — Robert May
(74) *Attorney, Agent, or Firm* — Viering, Jentschura & Partner mbB

(57) ABSTRACT

A lighting device includes an elongated profiled body with a web wall having first and second opposing faces, and two side walls to the side of the web wall, the latter having longitudinal slots extending therealong. In the profiled body, there may be provided an elongated light radiation source module including a support board with electrically conductive formations facing said longitudinal slots and at least one electrically-powered light radiation source which is in electrical contact with said electrically conductive formations. The light radiation source module is locatable in elongated profiled body extending between both side walls, with support board facing towards the first face of web wall. An electrical contact slider member slidable along the second face of web wall is provided with electrical contact pins adapted to extend into said longitudinal slots. Slider member is displaceable towards support board with pins contacting said electrically conductive formations of support board.

13 Claims, 5 Drawing Sheets

(51) Int. Cl.

| | |
|---|---|
| ***H01R 4/24*** | (2018.01) |
| *F21V 31/00* | (2006.01) |
| *F21V 19/00* | (2006.01) |
| *H01R 25/14* | (2006.01) |
| *F21Y 101/00* | (2016.01) |
| *F21Y 103/10* | (2016.01) |
| *F21Y 115/10* | (2016.01) |

(52) U.S. Cl.
CPC ..... *F21V 19/0035* (2013.01); *F21V 31/00* (2013.01); *F21Y 2101/00* (2013.01); *F21Y 2103/10* (2016.08); *F21Y 2115/10* (2016.08); *H01R 25/14* (2013.01)

(58) Field of Classification Search
CPC ..... F21Y 2103/20; F21Y 2103/30; F21Y 2103/33; F21Y 2103/37; F21Y 2115/10
See application file for complete search history.

(56) References Cited

U.S. PATENT DOCUMENTS

| | | | | |
|---|---|---|---|---|
| 5,045,981 | A | 9/1991 | Nagano | |
| 2007/0087619 | A1* | 4/2007 | Nall | F21V 21/002 439/417 |
| 2011/0075413 | A1 | 3/2011 | Smith et al. | |
| 2013/0176728 | A1* | 7/2013 | Bizzotto | F21V 21/08 362/244 |
| 2016/0025318 | A1 | 1/2016 | Skergeth et al. | |

FOREIGN PATENT DOCUMENTS

| | | |
|---|---|---|
| DK | 2078895 T3 | 4/2013 |
| EP | 2078895 | 7/2009 |

* cited by examiner

LIGHTING DEVICE AND CORRESPONDING METHOD UTILIZING AN ELONGATED PROFILED BODY WITH WEB WALL HAVING LONGITUDINAL SLOTS AND CONTACT SLIDER MEMBER WITH CORRESPONDING ELECTRICAL PINS

CROSS-REFERENCE TO RELATED APPLICATIONS

This application claims priority to IT 102015000031983 filed on Jul. 8, 2015, which is hereby incorporated by reference in its entirety.

TECHNICAL FIELD

Various aspects of this disclosure relate to lighting devices. One or more embodiments may refer to lighting devices employing electrically-powered light radiation sources, e.g. solid-state light radiation sources, such as LED sources.

BACKGROUND

Various luminaires may employ, as light radiation source assemblies, flexible modules such as protected LED flex modules. In such a module, the light radiation sources are arranged in a case adapted to ensure a protection against external agents (e.g. with an IPx-grade protection).

The electrical connection (for power supply, but optionally also for the transmission of control/feedback signals) of the light radiation sources may be implemented either via soldered wires or via connectors installed at the end of the module.

With this solution, as the connector may be rather bulky in order to cover the whole module profile, at the connector end carrying the connector it may be difficult to ensure a good thermal dissipation, e.g. for power modules. Moreover, the possibility of applying the connector only at the end of a module may jeopardize the installation flexibility thereof: e.g. the installer may be forced to arrange the power supply at a terminal position of the module, while on the contrary it would be preferable to have the possibility to implement the connection at any point along the module length.

The described solution may impose constraints also because the profile of the light radiation source module needs to be compatible with the connector volume and shape. Moreover, the separation or gap which may be created between the lighting module and the mounting substrate does not ensure a complete thermal coupling between the module and the substrate (heatsink) and may also affect the optical performance of the module.

To tackle with the problem, the module may be contacted completely with the plane of mounting substrate, either by implementing a direct soldering of the electrical contact pads or by creating a dedicated groove adapted to receive the protruding part of the connector. However, such solutions are quite complicated and may adversely affect the production and installation costs.

SUMMARY

One or more embodiments aim at overcoming the previously stated drawbacks.

According to one or more embodiments, said object is achieved thanks to a lighting device having the features specifically set forth in the claims that follow.

One or more embodiments may also refer to a corresponding method.

The claims are an integral part of the technical teaching provided herein with reference to the embodiments.

One or more embodiments may offer one or more of the following advantages:

possibility of implementing the LED module connection along the whole length of the module, in the positions provided with contact formations or pads;

optimization of thermal dissipation, thanks to the contact of the whole module with a mounting surface having thermal dissipation features, achievement of the tensile strength required by safety regulations for lighting device connectors, possibility of using one connector for a plurality of LED modules, a safe and reliable mechanical and electrical connection throughout the lifetime of the LED module, thanks to a mechanical fixation mechanism, possibility of designing the lighting device without taking into account the connector size, possibility of using one connector to supply a plurality of lighting modules along longer lengths than achievable with traditional connection arrangements.

One or more embodiments may provide power supply not from a connector but directly from the lighting device, so that the module may be supplied at any position between the ends, while ensuring a good thermal dissipation.

BRIEF DESCRIPTION OF THE FIGURES

One or more embodiments will now be described, by way of non-limiting example only, with reference to the enclosed figures, wherein.

DETAILED DESCRIPTION

In the following description, numerous specific details are given to provide a thorough understanding of exemplary embodiments. One or more embodiments may be practiced without one or more specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases such as "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

In the figures, reference 10 denotes the whole a lighting device.

Figure 1:
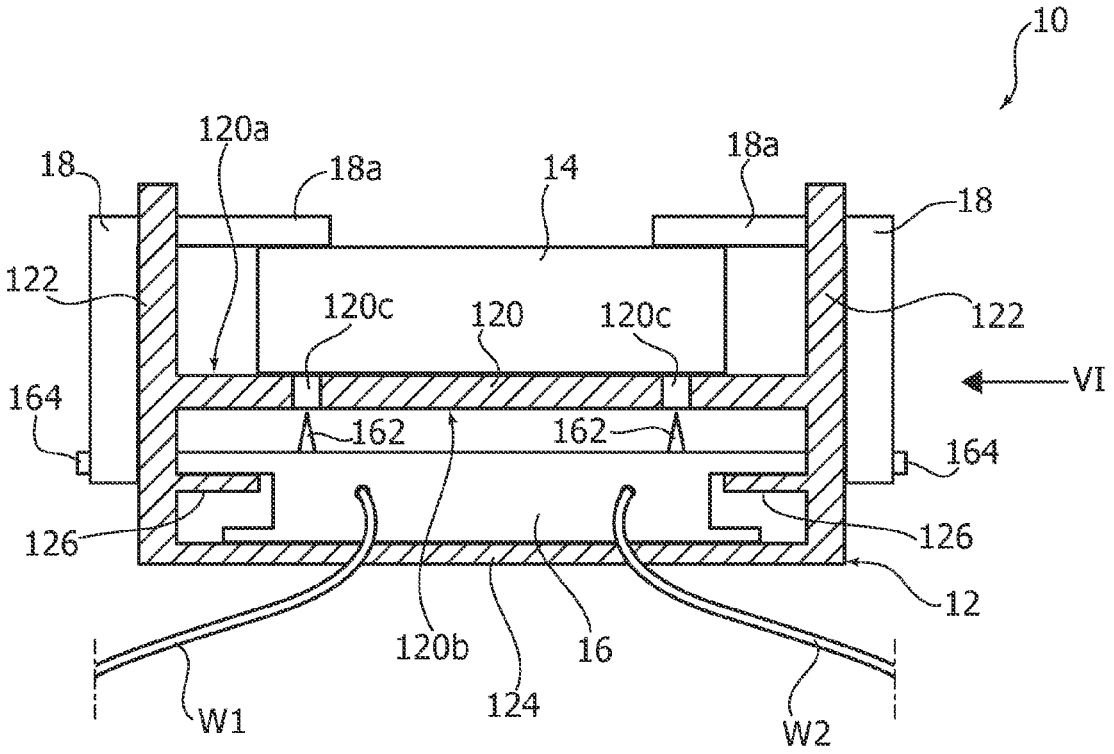
FIGS. 1 and 2 show the structure of lighting devices according to one or more embodiments, as well as their usage.
Figure 2:
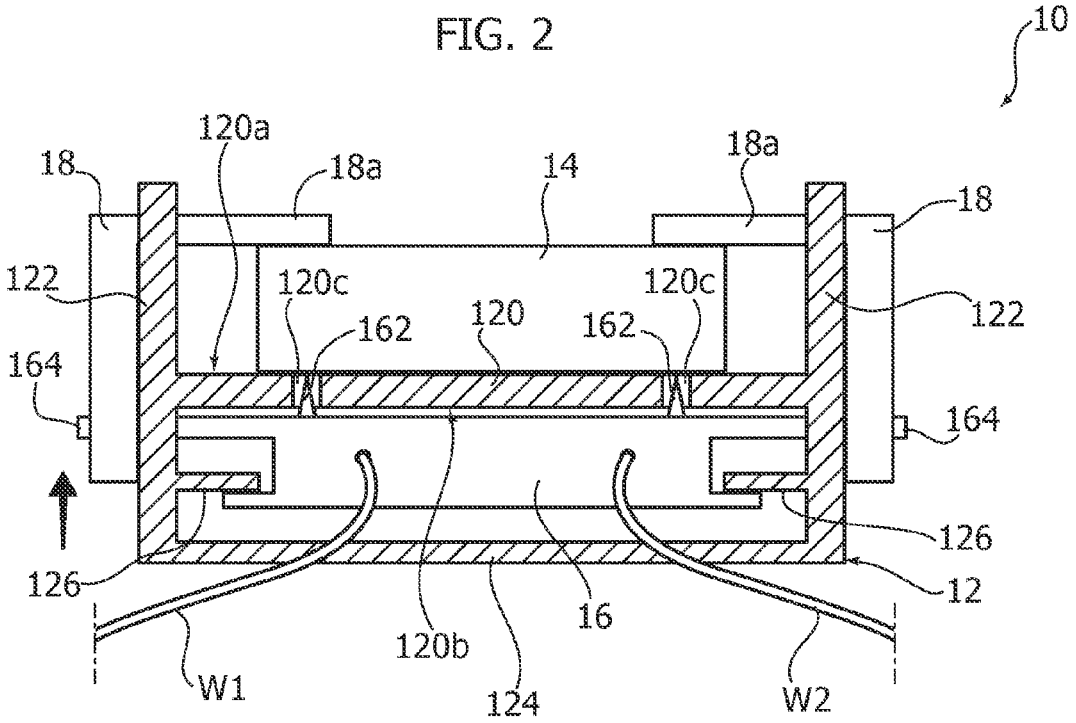

In one or more embodiments, device 10 has an elongated shape and may be seen, with the possible exception of what will be stated in the final part of this exemplary description, as a body of indefinite length shown in cross section in figures such as FIGS. 1 and 2.

In one or more embodiments, device 10 may comprise an elongated profiled body 12 having the function of a case comprising, in one or more embodiments, a web wall 120 (having two opposed faces 120*a* and 120*b*) and two side walls 122 extending sidewise of said web wall 120.

In one or more embodiments, body 12 may have a cross-section profile which is at least approximately H-shaped, adapted to be obtained by a back-to-back juxtaposition of mutually opposed channel-like portions:

the former being defined by the first face 120*a* of web wall 120 and by the portions of side walls 122 facing the same, and the latter being defined by the second face 120*b* of web wall 120 and by the portions of side walls 122 facing the same.

In one or more embodiments, body 12 may be a profiled body obtained via techniques such as extrusion, e.g. as a bar or a ribbon-shaped element which is at least slightly flexible.

In one or more embodiments, body 12 may comprise a material (e.g. a metal or a plastic material) having good thermal conductivity features, so that it can optionally perform the function of a heatsink.

In one or more embodiments, a light radiation source module 14 may be inserted into the first portion of previously described profiled body 12, i.e. the portion lying between the "front" face 120*a* of wall 120 and the portions of side walls 122 facing the same.

Figure 3:
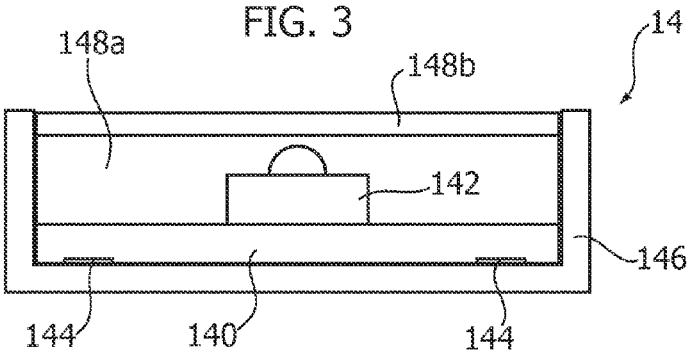
FIGS. 3 to 5 show possible features of a lighting device according to one or more embodiments.

In one or more embodiments, module 14 may have a structure as exemplified in FIG. 3.

In one or more embodiments, module 14 is substantially comprised of a so-called "flex" module, and comprises an optionally flexible support board 140 having a structure comparable to a Printed Circuit Board (PCB), optionally a double layer PCB.

In one or more embodiments, a (front) face of board 140 may mount one or more electrically powered light radiation sources 142. The latter may be e.g. solid-state light radiation sources, such as LED sources.

Board 140 also hosts electrically conductive formations 144, which are only partially visible in the drawings, which may take the form of pads electrically contacting light radiation source(s) 142 via lines extending on or in board 140.

Figure 4:
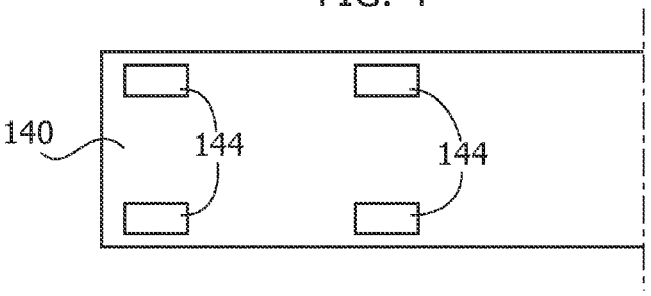

By way of example and referring to FIG. 4 (which shows board 140 viewed from the back side, below in FIG. 3), these formations enable the power supply to source(s) 142, e.g. with "hot" pads (e.g. 24 V pads) and ground pads (GND) located e.g. on opposed sides of board 140 and on the (back) face of board 140 itself.

In one or more embodiments, light radiation source module 14 may be provided with a protection, wherein the previously described structure is inserted in a channel-shaped case 146 made e.g. of silicone, with support board 140 and light radiation source(s) being embedded in one or more sealing masses, which may consist of a polymer material, e.g. silicone 148*a*, 148*b*: the presence of two different references exemplifies that, in one or more embodiments, said sealing masses, which are adapted to impart module 14 protection features (e.g. IPx-grade protection) may comprise masses of different sealing materials, e.g. white silicone (layer 148*a*) adapted to mask the front face of board 140 and of the components mounted thereon, and transparent silicone (layer 148*b*) which brings about a complete sealing of the module, without adversely affecting the light radiation emission from module 14.

As can be seen in FIGS. 1 and 2, in one or more embodiments module 14 may be arranged within profiled body 12, so that it is located between side walls 122 with support board 140 facing first face 120*a* of web wall 120.

A combined observation of FIGS. 1 and 2, on one side, and of FIG. 3, on the other side, shows that the position of board 140 facing first face 120*a* of web wall 120 does not necessarily imply that board 140 contacts web wall 120: in one or more embodiments, as exemplified in the Figures, the web or bottom portion of channel-shaped case 146 extends between board 140 and web wall 120.

In one or more embodiments, in the portion of case 12 opposed to face 120*b* of web wall 120 (i.e. the lower portion of profiled body 12 in FIGS. 1 and 2) an electrical contact slider member 16 may be provided which is connected, in one or more embodiments, to electrical wires or cables (e.g. W1, W2) which must be electrically contacted with light radiation source(s) 142 via contact formations 144.

One or more embodiments as presently exemplified may provide wires or cables adapted to perform the power supply to light radiation source(s) 142. In one or more embodiments, a higher number of wires or cables may be envisaged, e.g. in order to perform a "smart" control function of source(s) 142 and/or a signal feedback function (e.g. thermal sensing signals) from source(s) 142.

Figure 5:
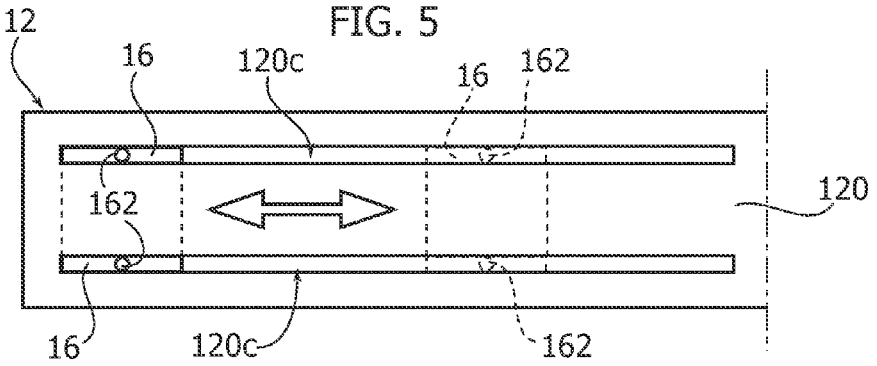

In one or more embodiments as exemplified herein, wires or cables W1, W2 may be connected to electrical contact pins 162 (in this case two pins, the number corresponding to the number of wires or cables W1, W2) adapted to extend in corresponding slots or grooves 120*c*, extending along web wall 120. In one or more embodiments, slider 16 may therefore slide lengthwise of web wall 120, i.e. with respect to body 12, as schematically shown with a dashed line and a double arrow in FIG. 5, which may be considered a sort of ideal top view of web wall 120 of body 12, while module 14 is not shown for clarity.

Slider 16 (and electrical contact pins 162 provided thereon) may thus be arranged in any lengthwise position of body 12 corresponding to slots 120*c*, pins 162 being adapted to face electrical contact formations 144 provided on the back side of support board 140 of module 14.

Once a desired location has been reached along the lengthwise extension of body 12 (e.g. corresponding to certain contact formations 144), slider 16 may be advanced towards web wall 120 (i.e. towards module 14) as schematically shown in the sequence of FIGS. 1 and 2.

In this way, through slots 120*c*, contact pins 162 may be brought into electrical contact with formations 144. In one or more embodiments, such an operation may involve piercing the web wall of case 146 and, optionally, an at least slight perforation of the wall of board 140, thanks to pins 162 (e.g. metal pins) having sharp distal portions.

The sliding displacement of slider 16 along body 12, as well as the advancing movement of slider 16 in the direction which brings pins 162 into contact with formations 144, may be obtained by acting directly on slider 16 if the latter may be accessed from the outside, i.e. if the channel-shaped portion of profiled body 12, defined by back face 120*b* of web wall 120 and by the portions of side walls 122 facing the same, has an open channel shape.

In one or more embodiments, as exemplified in FIGS. 1 and 2, said channel-shaped portion of body 12, which displaceably mounts slider 16, is a closed channel shape due to the provision of a cover wall 124. Such a closed or covered channel shape may lead to the presence, on the back side of device 10 which will be mounted onto a support substrate, of a bottom wall 124 of body 12, which is continuous with web wall 120 (through the portions of the interposed side walls 122). In one or more embodiments a dissipation path may thus be created for the heat generated during the operation of light radiation source(s) 142, leading from web wall 120 towards bottom wall 124 and towards the substrate which supports wall 124.

In one or more embodiments, cantilever formations 126 projecting from side walls 122 of body 12 (see FIGS. 1 and 2) may contribute to smoothing the sliding displacement of slider 12 more regular.

Figure 6:
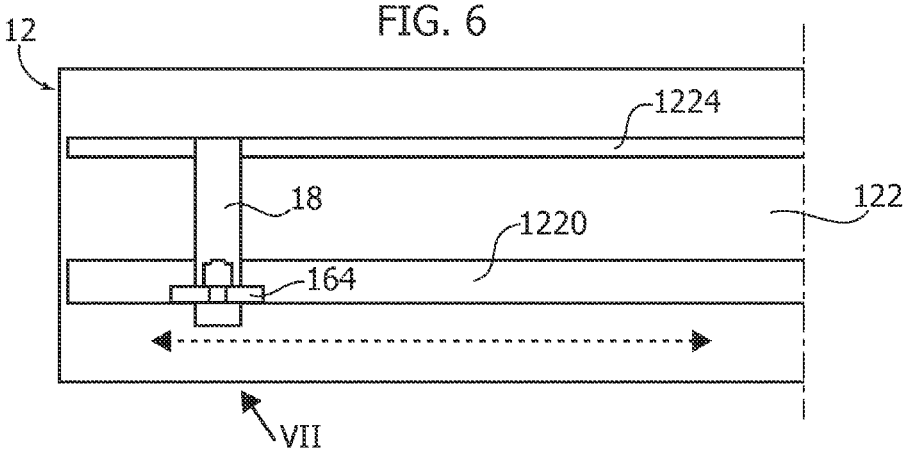
FIG. 6 is a view corresponding to arrow VI of FIG. 1, shown in an enlarged scale.
Figure 7:
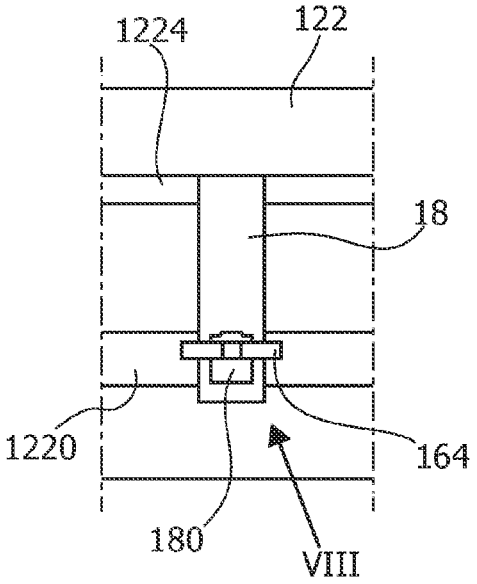
FIG. 7 shows the portion of FIG. 6 denoted by arrow VII in the operating condition corresponding to FIG. 2.

In one or more embodiments, e.g. in the embodiments wherein slider 16 cannot be accessed directly from the outside, the sliding displacement of slider 16 along body 12, as well as the advancing movement of slider 16 which brings pins 162 into contact with formations 144, may be obtained by acting on side appendixes 164 of slider 16, which project laterally from slider 16 and extend through slots 1220 (see specifically FIGS. 6 and 7 and, as regards the final statements in this description, FIG. 10) of side walls 122.

In one or more embodiments, the function of advancing slider 16 towards web wall 120 and towards module 14 may be complemented with a function of retaining slider 16 in the advanced position, wherein pins 162 establish the electrical contact with formations 144 of board 140.

For example, in one or more embodiments, appendixes 164 may be adapted to cooperate with respective anchoring formations 18, which may have (as shown e.g. in FIGS. 1 and 2) a cantilever or L-shaped cross section profile, e.g. a web branch being substantially co-extensive with side walls 122 of body 12 (e.g. with the outer surface thereof) and a transverse branch which goes through slots 1224 in each side wall 122 (again, see FIGS. 6 and 7 and, with reference to what will be explained in the following, FIG. 10), so as to have a distal section 18*a* projecting into body 12. In one or more embodiments, distal section 18*a* is adapted to rest on module 14, while enclosing it at least partially at the front face thereof, i.e. the face through which the light radiation generated by source(s) 142 is emitted from front side or face of device 10.

Figure 8:
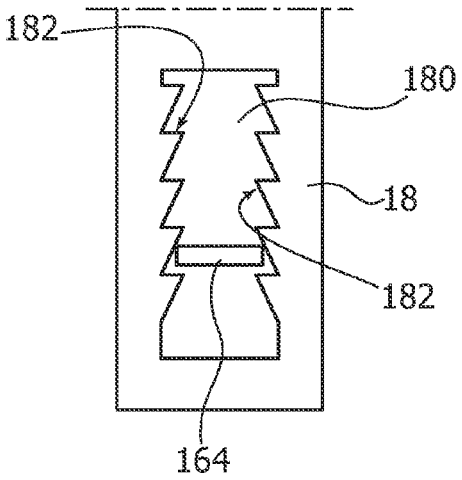
FIG. 8 is a view according to arrow VIII of FIG. 7, shown in an enlarged scale, FIG. 9, comprising two parts respectively denoted as a) and b), shows possible mounting criteria of one of the elements of a lighting device according to one or more embodiments.

In one or more embodiments, as exemplified in FIG. 8, the cooperation between the ends 164 of slider 16 and the anchoring formations 18 may be implemented by the provision, in the base or distal branch of each formation 18, of a slot 180. Through slots 180, appendixes 164 of slider 16 may project outside device 10, so as to be pushed (together with slider assembly 16) towards web wall 120 and towards module 14 and perform the displacement sequence exemplified in FIGS. 1 and 2.

In one or more embodiments, as exemplified in FIG. 8, slot 180 may have generally sawtooth-shaped side walls 182, exhibiting an asymmetric triangle-shaped tooth profile, in such a way as to facilitate the advancement of appendixes 164 (of slider 16) towards web wall 120 while hindering the withdrawal thereof in the opposite direction: the configuration is therefore such as to retain slider 16 in the advanced position, wherein pins 162 are in contact with contact formations 144 of module 14.

Figure 9:
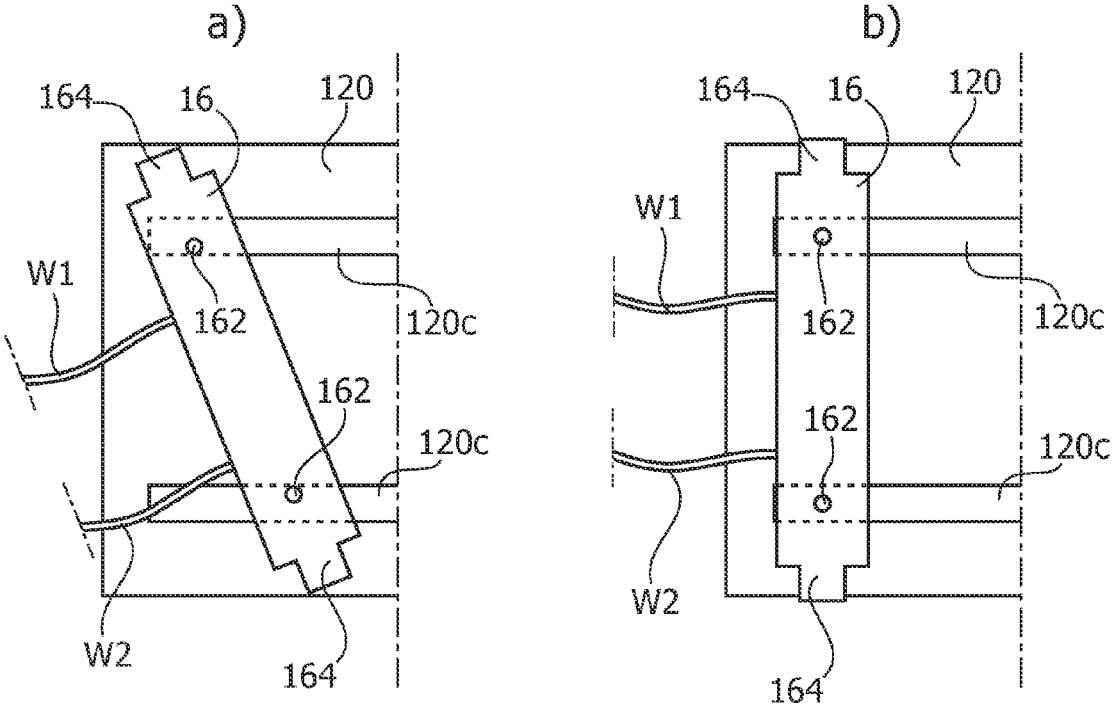

Parts a) and b) in FIG. 9 show possible criteria which may be followed in order to insert slider 16 into body 12 even when the portion of body 12 adapted to receive slider 16 has a closed channel shape (with a cover or bottom wall 124).

It will be appreciated, however, that the representation in FIG. 9 is deliberately simplified, and omits a detailed representation of the concerned components, e.g. as regards the specific features of both appendixes 164 projecting outside body 12, which are here represented schematically.

For example, the sequence of parts a) and b) in FIG. 9 shows that slider 16 may be inserted into body 12 by introducing it with an inclined orientation, by placing pins 162 at a position at least roughly corresponding to slots 120 (it will be appreciated that, in the initial mounting condition, pins 162 need not necessarily extend within slots 120*c*). Slider 16 may then be rotated orthogonally of the lengthwise extension of body 12 (see the transition from part a) to part b) of FIG. 9). This movement is continued until the condition is reached wherein both appendixes 164 project outside body 12, so that they may cooperate with anchoring formations 18 according to the previously stated criteria.

Figure 10:
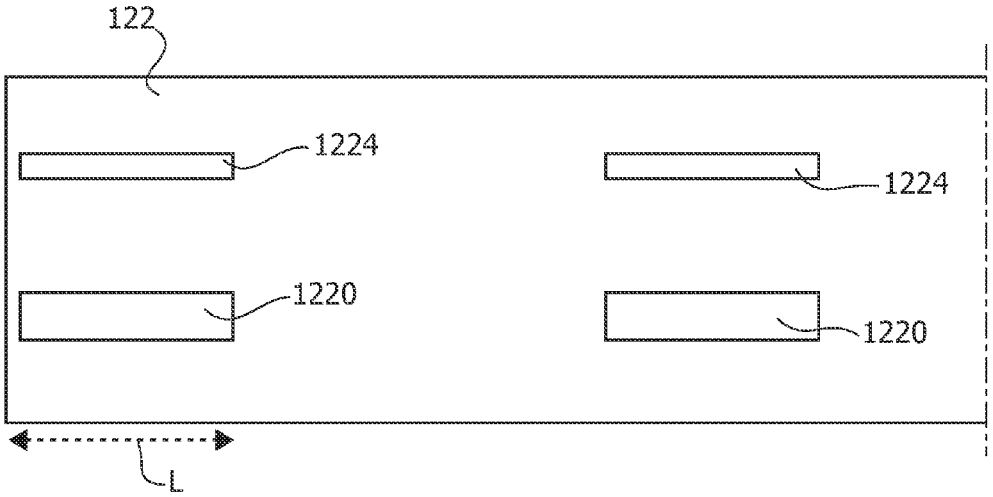
FIG. 10 shows possible implementation details of one or more embodiments.

FIG. 10 exemplifies (as regards slots 1220 and 1224; similar considerations apply, however, to slots 120*c*) that the sliding stroke of slider 16 with respect to body 12 must not necessarily cover the whole lengthwise extension of body 12.

For example, as exemplified in FIG. 10, slots 1220, 1224 (and primarily slots 120*c* in web wall 120 of body 12) may extend discontinuously, e.g. by being divided into subsequent sections separated by portions wherein the wall of body 12 is continuous (FIG. 10 exemplifies this feature with reference to side walls 122, but the same is true for web wall 120).

In this way, the adjustment stroke of slider 16 may concern distinct portions, denoted as L, of the lengthwise extension of body 12 (and therefore of device 10 on the whole).

For example, the extension of sliding stroke L may be chosen so that it covers (by way of example and not of limitation) a distance amounting approximately to the separation (see FIG. 4) of subsequent electrical contact formations 144 on board 140 of module 14.

In this way the position of slider 16 (a position wherein the electrical contact may be established between pins 162 and pads 144) may be adjusted by choosing e.g. an end position or an internal position with respect to the lengthwise extension of module 14 and of device 10 on the whole.

In this regard, it will be appreciated that FIG. 4 refers to electrical contact formations 144 which are located in discrete positions along the lengthwise extension of board 140 of module 14. In one or more embodiments, such electrical contact formations may extend continuously on board 140: in this case, on the basis of the application needs or tastes, any position along such extension may be chosen for slider 16.

FIGS. 11 to 14 exemplify the possibility of using solutions according to one or more embodiments together with modules 10 which are divided into a plurality of units.

Figure 11:
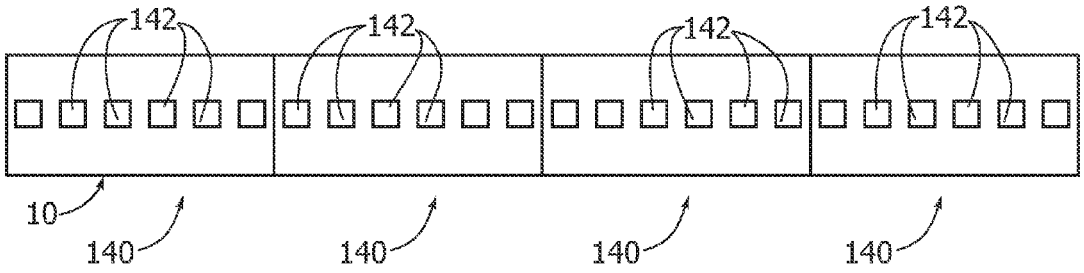
FIGS. 11 to 14 show various possible uses of lighting devices according to one or more embodiments.
Figure 12:
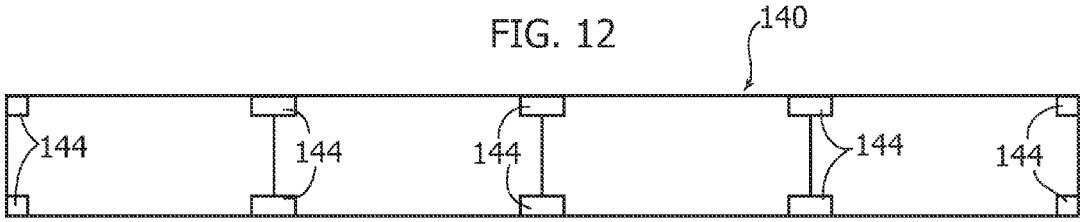

E.g., FIG. 11 is an ideal plan view of a module 10 which is divided into four units (sometimes named Single Electrical Units, SEUs) having an arrangement of electrical contact formations 144 as exemplified in FIG. 12.

In this case, slider 16 may be displaced along the various units which compose device 10, and may establish electrical contact at any one of the lengthwise positions where electrical contact formations 144 are provided.

Assuming, by way of example, that each of the units exemplified in FIGS. 11 and 12 is approximately 20 cm long, slots 120*c* (and slots 1220, 1224) may be slightly longer than 20 cm, so as to establish electrical contact with formations 144 arranged at any lengthwise position of device 10.

Figure 13:
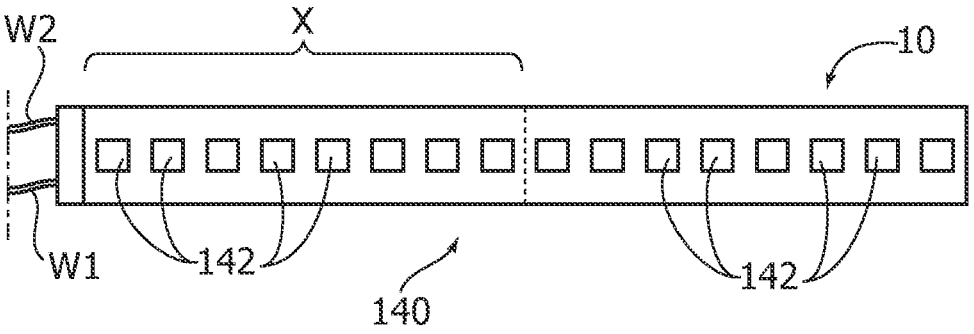
Figure 14:
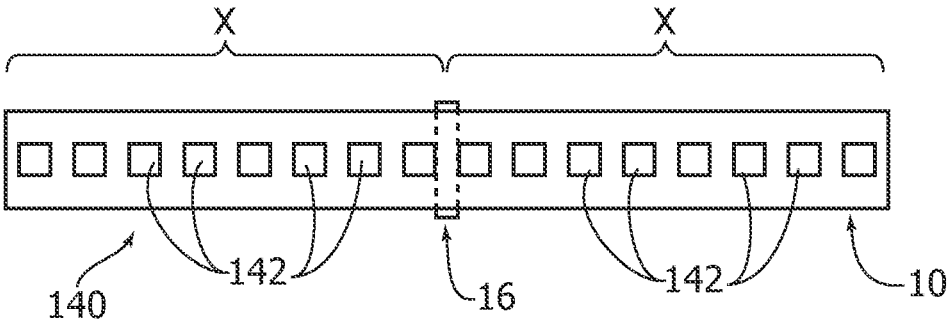

FIG. 13 and FIG. 14 exemplify the possibility, offered by one or more embodiments, of overcoming a constraint which may arise when, as exemplified in FIG. 13, a lighting device 10 is supplied at one of the ends thereof.

In this case, because of a voltage drop along the device, a portion of device 10 arranged near supply W1, W2 may show, e.g. for a length X, a brightness which is higher than in the remaining part of device 10.

As exemplified in FIG. 14, one or more embodiments enable the arrangement of slider 16 (and therefore of the power supply of device 10) at a middle position of device 10. In this way, on each side of the location of slider 16, a region of sufficient brightness may be obtained which is not affected by the deterioration due to the voltage drop.

Of course, without prejudice to the underlying principles, the details and the embodiments may vary, even appreciably, with respect to what has been described herein by way of non-limiting example only, without departing from the extent of protection.

The extent of protection is defined by the annexed claims.

The invention claimed is:

1. A lighting device, comprising:

an elongated profiled body with a web wall having first and second opposing faces, and two side walls to the side of said web wall, said web wall having longitudinal slots extending therealong;

an elongated light radiation source module including a support board with electrically conductive formations facing said longitudinal slots and at least one electrically-powered light radiation source thereon, said at least one light radiation source in electrical contact with said electrically conductive formations, wherein said light radiation source module is locatable in said elongated profiled body extending between said two side walls with said support board facing towards the first face of said web wall; and an electrical contact slider member slidable along the second face of said web wall with electrical contact pins configured to extend into said longitudinal slots, said slider member displaceable towards said support board with said electrical contact pins contacting said electrically conductive formations in said support board.

2. The lighting device of claim 1, wherein said profiled body comprises opposing first and second channel-shaped portions at said first and second faces of said web wall, respectively, wherein said light radiation source module is locatable in said first channel-shaped portion and said slider member is longitudinally slidable in said second channel-shaped portion.

3. The lighting device of claim 1, wherein said electrical contact pins in said slider member comprise sharp distal portions to at least partially puncture said light radiation source module at said support board.

4. The lighting device of claim 1, wherein said slider member is coupleable with anchoring formations engaging said profiled body to retain said slider member in an advanced position towards said support board with said electrical contact pins contacting said electrically conductive formations in said support board.

5. The lighting device of claim 4, comprising adjustable coupling formations between said slider member and said anchoring formations.

6. The lighting device of claim 5, wherein said adjustable coupling formations comprise extensions of said slider member extending into slots in said anchoring formations.

7. The lighting device of claim 6, wherein said slots comprise sawtooth-shaped sides for coupling with said extensions of said slider member.

8. The lighting device of claim 1, wherein said longitudinal slots extending along said web wall are discontinuous, with discontinuities located between adjacent electrically conductive formations in said support board.

9. The lighting device of claim 1, wherein said light radiation source module comprises a plurality of subsequent units with respective support board units having respective electrically-conductive formations.

10. The lighting device of claim 9, wherein said solid state source is an LED source.

11. The lighting device of claim 1, wherein said light radiation source module is a protected module with said support board and said at least one light radiation source arranged in a protective case.

12. The lighting device of claim 1, wherein said at least one electrically-powered light radiation source includes a solid state source.

13. A method of installing a lighting device, the method comprising:

providing an elongated profiled body with a web wall having first and second mutually opposed faces and two side walls sidewise of said web wall, said web wall having longitudinal slots extending therealong, arranging in said profiled body an elongated light radiation source module including a support board with electrically-conductive formations facing said longitudinal slots and at least one electrically-powered light radiation source thereon, said at least one light radiation source in electrical contact with said electrically-conductive formations, said light radiation source module extending between said two side walls with said support board facing towards the first face of said web wall, providing an electrical contact slider member slidable along the second face of said web wall with electrical contact pins adapted to extend into said longitudinal slots, and bringing said slider member at a certain longitudinal location along said profiled body and displacing said slider member at said longitudinal location towards said support board to bring said electrical contact pins in contact with said electrically-conductive formations in said support board.

* * * * *